US008237095B2

(12) United States Patent
Glaros et al.

(10) Patent No.: US 8,237,095 B2
(45) Date of Patent: Aug. 7, 2012

(54) SPOT LEADING TARGET LASER GUIDANCE FOR ENGAGING MOVING TARGETS

(75) Inventors: Louis N. Glaros, Ocoee, FL (US); William B. Eddins, Belle Isle, FL (US); Charles Gaylord, Orlando, FL (US); Michael Kincheloe, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 330 days.

(21) Appl. No.: 12/783,681

(22) Filed: May 20, 2010

(65) Prior Publication Data

US 2011/0204178 A1 Aug. 25, 2011

Related U.S. Application Data

(60) Provisional application No. 61/307,699, filed on Feb. 24, 2010.

(51) Int. Cl.

| | |
|---|---|
| ***F41G 7/30*** | (2006.01) |
| ***F42B 15/01*** | (2006.01) |
| *F41G 7/00* | (2006.01) |
| *F42B 15/00* | (2006.01) |

(52) U.S. Cl. ..... 244/3.16; 244/3.1; 244/3.11; 244/3.13; 244/3.15; 89/1.11; 356/138; 356/152.1

(58) Field of Classification Search ..... 244/3.1–3.19; 89/1.11, 1.1; 356/3, 4.01, 5.01, 138, 140–153; 372/109; 348/169–172

See application file for complete search history.

(56) References Cited

U.S. PATENT DOCUMENTS

| | | | | |
|---|---|---|---|---|
| 3,233,847 | A | 2/1966 | Girsberger | |
| 3,982,714 | A | 9/1976 | Kuhn | |
| 4,004,487 | A * | 1/1977 | Eichweber | 244/3.15 |
| 4,008,869 | A | 2/1977 | Weiss | |
| 4,047,117 | A * | 9/1977 | Tuchyner et al. | 244/3.16 |
| 4,111,383 | A * | 9/1978 | Allen et al. | 244/3.13 |
| 4,155,096 | A * | 5/1979 | Thomas et al. | 348/169 |
| 4,243,187 | A * | 1/1981 | Esker | 244/3.13 |
| 4,349,838 | A * | 9/1982 | Daniel | 348/169 |
| 4,422,758 | A * | 12/1983 | Godfrey et al. | 356/152.1 |
| 4,709,875 | A * | 12/1987 | Cremosnik et al. | 244/3.13 |
| 5,506,675 | A * | 4/1996 | Lopez et al. | 356/152.1 |
| 5,544,843 | A * | 8/1996 | Johnson | 244/3.11 |
| 5,651,512 | A * | 7/1997 | Sand et al. | 244/3.11 |
| 5,695,152 | A * | 12/1997 | Levy | 244/3.13 |

(Continued)

FOREIGN PATENT DOCUMENTS

EP 1439369 A2 7/2004

(Continued)

*Primary Examiner* — Bernarr Gregory

(74) *Attorney, Agent, or Firm* — Jetter & Associates, P.A.

(57) ABSTRACT

A laser lead designator for guiding a laser guided weapon (LGW) to strike a moving target includes a laser source for providing a laser beam and a controller coupled to receive a position and a velocity of the moving target. The controller provides a control signal for pointing the laser beam a specified lead distance ahead of the position of the moving target to position a laser spot on a ground location ahead of the moving target. The lead distance compensates for an impact shortfall value that is a function of at least one shortfall parameter including a speed of the moving target so that the LGW shortfalls the laser spot on the moving target. The laser designator is separate from the LGW.

23 Claims, 4 Drawing Sheets

U.S. PATENT DOCUMENTS

| | | | | |
|---|---|---|---|---|
| 5,734,466 | A * | 3/1998 | George et al. | 356/141.3 |
| 6,138,944 | A * | 10/2000 | McCowan et al. | 244/3.13 |
| 6,161,061 | A * | 12/2000 | Bessacini et al. | 244/3.13 |
| 6,568,627 | B1 | 5/2003 | Jones et al. | |
| 6,766,979 | B2 * | 7/2004 | Horwath | 244/3.17 |
| 6,817,569 | B1 * | 11/2004 | Horwath | 244/3.17 |
| 7,175,130 | B2 * | 2/2007 | Dubois et al. | 244/3.13 |
| 7,745,767 | B2 * | 6/2010 | Bredy | 244/3.16 |
| 7,767,945 | B2 * | 8/2010 | Williams | 244/3.16 |
| 7,834,300 | B2 * | 11/2010 | Zemany et al. | 244/3.15 |
| 7,964,831 | B2 * | 6/2011 | Hurty | 244/3.11 |

FOREIGN PATENT DOCUMENTS

| | | |
|---|---|---|
| EP | 1903294 | 3/2008 |
| WO | 0114820 | 3/2001 |

* cited by examiner

SPOT LEADING TARGET LASER GUIDANCE FOR ENGAGING MOVING TARGETS

CROSS REFERENCE TO RELATED APPLICATIONS

This application and the subject matter disclosed herein claims the benefit of Provisional Application Ser. No. 61/307,699 entitled "SPOT LEADING TARGET LASER GUIDANCE FOR ENGAGING MOVING TARGETS", filed Feb. 24, 2010.

FIELD

Disclosed embodiments relate to laser lead guidance for weapons.

BACKGROUND

Laser guidance is a technique of guiding a weapon such as a missile or a bomb to a target using a laser beam or spot. As known in the art, there are both internal laser designators and external laser designators. A laser guided weapon (LGW) is weapon which uses a seeker (e.g., targeting sensor) to detect laser energy reflected from a laser marked/designated target and through signal processing provides guidance commands to a control system which guides the LGW to the target point from which the laser energy is being reflected.

An example of an external designator is a beam rider. In beam riding, first, an aiming station in the launching area directs a narrow radar or more commonly a laser beam at a target, such as an enemy aircraft or tank. Then, the LGW (e.g., missile or other projectile) is launched and at some point after launch is "gathered" by the radar or laser beam when it flies into it. From this stage onwards, the LGW attempts to keep itself within the beam, while the designator station keeps the beam pointed at the target. The LGW, controlled by a laser or radar seeking guidance kit including photodetectors and a computer inside it, "rides" the beam to the target.

More commonly, the guidance system is internal to the LGW and operation is similar to semi-active radar homing. With this technique, the laser is kept pointed at the target and the laser beam bounces off the target and is scattered in all directions, known as "painting the target". The LGW is launched or dropped near the target. When the LGW is close enough that some of the reflected laser energy from the target reaches it, a laser seeker detects which direction this energy is coming from and adjusts the LGW trajectory towards the source/target. As long as the LGW is in the general area and the laser is kept aimed at the target, the LGW is generally guided accurately to the target.

Many existing LGWs or guidance kits utilize weather vane detection sensors as key elements in the vehicle control loop. As a result, steering of the LGW defaults to classic Velocity Pursuit Guidance (VPG). VPG is a guidance technique that points the guidance beam on the target during which the flight direction (velocity vector) of the LGW is commanded towards the current target location. Against stationary targets this provides satisfactory terminal engagement performance, usually corrupted only by residual vertical bias uncertainties and common mode instrumentation and seeker errors. Against moving targets, however, VPG generally defaults to a tail chase endgame regardless of the initial engagement geometry. In this environment, sluggish g-limited airframes typically run out of maneuver space before their speed advantage can overtake the target and they shortfall their intended impact points by an amount dependent on the engagement geometry, LGW airframe capability, terminal lasing time, and target speed. This terminal guidance effect renders these particular LGWs being ineffective against all but the slowest moving targets.

Laser lead guidance is known for both internal laser designators and external laser designators, including guidance for compensating for shortfall due to target movement. In laser lead guidance the guidance beam is pointed on the target. For example, compensation for shortfall has been addressed by replacing the LGW steering implementation with Proportional Navigation Guidance (PNG) and mitigating moving target shortfall by building lead into the LGW control loops through detection sensor inertial stabilization. Problems with the PNG approach for solving the above-described shortfall problem include generally being costly for existing LGWs because of the need to replace the sensors and implement PNG for every LGW.

SUMMARY

As described above, most known LGWs or guidance kits utilize weather vane detection sensors that are fundamental to the guidance issue, and result in LGWs based on weather vane detection sensors being ineffective against all but the slowest moving targets. Moreover, retrofitting known LGWs to add PNG to address the shortfall problem for moving targets is costly and must be performed on all LGWs.

Laser lead designators disclosed herein provide off-target laser lead guidance for LGWs that address the shortfall problem for moving targets. Disclosed embodiments involve only small changes to the targeting sensor at the laser designator (e.g., software implemented algorithms and/or tables) that do not require any change to the LGW, thus providing a minimum cost solution to the moving target problem while utilizing existing LGW assets that lack onboard inertial navigation. A significant advantage provided by disclosed embodiments is that the LGW, such as a laser guided bomb (LGB), does not receive any lead information, but rather responds to the lead information (follows the off-target laser spot) provided by the external laser lead designator.

In a typical embodiment, the laser lead designator and target tracker are provided together in a laser lead designator and target tracker system. The target tracker component of the laser designator/tracker determines a position and a velocity of the moving target. The laser lead designator points its laser beam a specified lead distance ahead of the moving target to provide a laser spot that is incident at an off-target position (e.g., the ground or vegetation on the ground) in front of the moving target, with the specified lead distance for compensating an impact shortfall value. The lead distance can be converted to, or expressed as, a target relative heading angle, but the actual lead amount is a linear distance. The Inventors have recognized that impact shortfall values are functions of at least one shortfall parameter including a speed of the moving target, with the shortfall variables generally also including the engagement geometry and particular LGW's maneuver capability. As used herein, the LGW maneuver capability refers to the number of g's the airframe can pull. Based on the impact shortfall value, specified lead distances can be provided by calculation, or obtained from a table stored in memory so that the LGW shortfalls the laser spot on the moving target.

In operation, the targeting sensor of the LGW detects laser energy from the off-target spot position, not energy from a laser marked/designated target as employed in known laser designators. The LGW's signal processing provides guidance commands to its control system which guides the LGW to the off-target spot position leading to a trajectory that results in the LGW impacting the moving target.

DETAILED DESCRIPTION

Figure 1:
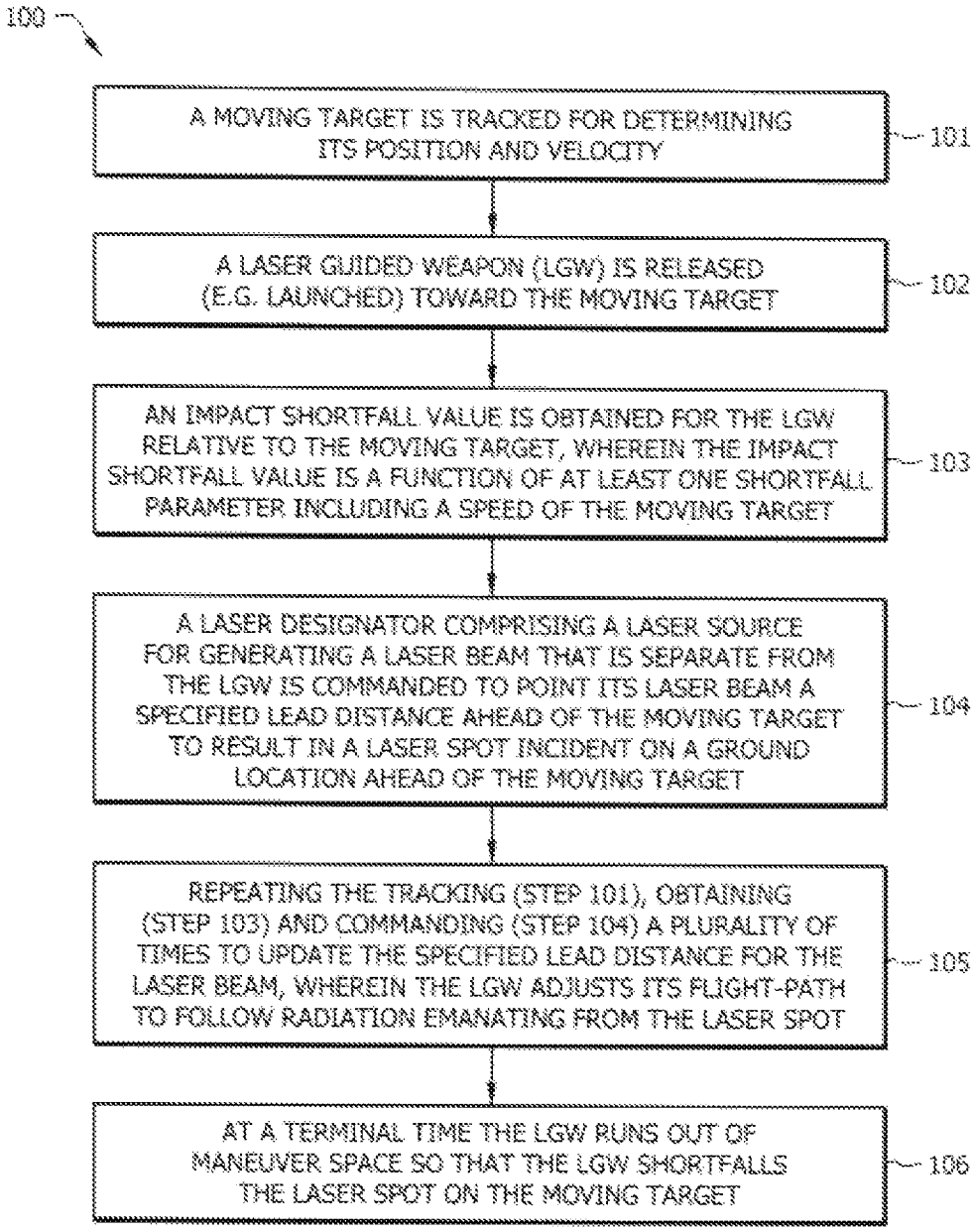
FIG. 1 is a flow chart showing steps in an exemplary laser lead method that uses an off-target laser spot for guiding a LGW to shortfall the laser spot by a lead distance to strike a moving target, according to a disclosed embodiment.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with this Disclosure.

FIG. 1 is a flow chart showing steps in an exemplary laser lead method 100 that uses an off-target laser spot for guiding a LGW to shortfall the laser spot by a distance to strike a moving target, according to a disclosed embodiment. The LGW can comprise an LGB, a laser guided missile (LGM), or in some arrangements, a laser guided bullet. The LGW is generally unpowered, and can use small wings to glide towards their targets. However, disclosed embodiments can also be applied to powered LGWs, such as powered LGMs. As described above, the LGW can lack onboard inertial navigation.

In step 101, the moving target is tracked for determining a position and a velocity of the moving target. In one embodiment the target is precision tracked, such as using a laser ranger, for example, as necessary to maintain robust target state estimation (TSE) velocity predictions. Laser ranging generally involves pointing the laser beam on the target. In another embodiment, target tracking is entirely passive, using known passive imaging methods.

In step 102, the LGW is released (e.g., launched) toward the moving target. It is sometimes possible for the LGW to be released before target tracking (step 101).

Step 103 comprises obtaining an impact shortfall value for the LGW relative to the moving target, wherein the impact shortfall value is a function of at least one shortfall parameter including a speed of the moving target. As described above, the shortfall parameters generally also include the engagement geometry and the maneuver capability of the particular LGW.

Step 104 comprises commanding a laser lead designator comprising a laser source for generating a laser beam that is separate from the LGW to point its laser beam a specified lead distance ahead of the moving target to result in a laser spot incident on a ground location ahead of the moving target. The specified lead distance is for compensating for the impact shortfall value. The lead distance is the amount the algorithm employed estimates the LGW to shortfall the spot. Accordingly, the lead distance and the impact shortfall value follow one another and become essentially equal immediately before the LGW hits the target. In a typical embodiment, the line of sight (LOS), to which the laser lead designator is bore sighted, is commanded the specified lead distance ahead of the target.

The lead distance can be adjusted to compensate for wind. For example, wind compensation can be embedded in either a separate lead table for each wind condition or as a multiplier on a standard table of lead distances.

The laser designator can be located in the delivery aircraft, another aircraft, a satellite, or on a ground location. One ground site location is a ground launch site (e.g., see FIG. 2B described below). Aircrafts can include helicopters, airplanes, or UAVs.

In a typical embodiment, the laser lead designator radiates a narrow beam of pulsed energy in the near-infrared wavelength spectrum, which is not visible to the human eye. However, other bands of electromagnetic radiation may be used. Moreover, it is possible for radiation sources other than lasers be used in certain embodiments. The laser beam is aimed so the energy is precisely pointed a specified lead distance ahead of the moving target to result in a laser spot incident on a ground location ahead of the moving target. As known in the art, the laser spot size is a function of beam divergence and the distance from the laser designator to the target. For example, if a designator has a beam spread or divergence of 1 milliradian (mr), its spot would have a diameter of approximately 1 meter (m) at a distance of 1,000 m.

Step 105 comprises repeating the tracking, obtaining and commanding a plurality of times to update the specified lead distance for the laser beam, wherein the LGW adjusts its flight-path to follow radiation emanating (e.g., scattered or reflected) from the laser spot. In one particular embodiment, updates are at 60 Hz, or 1 update every 1/60 second. In step 106, at a terminal time the LGW runs out of maneuver space so that the LGW shortfalls the laser spot on the moving target.

Figure 2A:
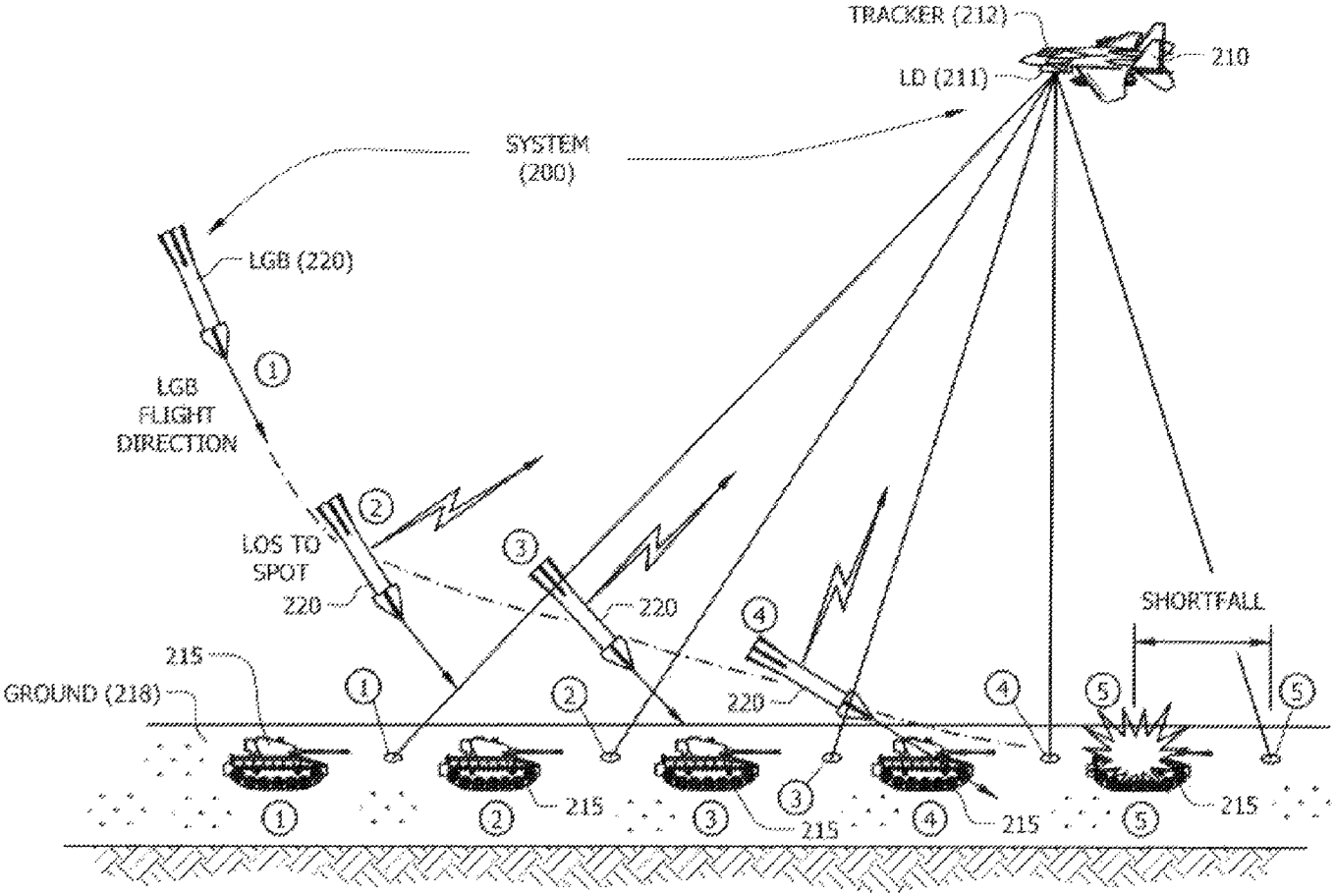
FIG. 2A is a depiction of a LGW delivery system showing positions of the laser spot from the laser lead designator and the LGW at several instances of time that demonstrates how laser lead guidance as disclosed herein compensates for moving target LGW terminal engagement shortfall caused by LGW guidance loop lag, according to a disclosed embodiment.

FIG. 2A is a depiction of a LGW delivery system 200 showing positions of the laser spot from a laser lead designator and a LGW at several instances of time that demonstrates how laser lead guidance as disclosed herein compensates for moving target LGW terminal engagement shortfall caused by weapon guidance loop lag. The laser lead designator (LD) 211 is provided by a jet aircraft 210. In this embodiment, the tracker 212 for tracking the target, which is generally a laser tracker, is also provided by the aircraft 210. The moving target is shown as a tank 215. At a first time, marked 1, velocity pursuit guidance commands the LGW shown as a LGB 220 to fly in a LOS direction towards the current laser spot location, which as described above is positioned by the laser lead designator 211 to be a specified lead distance ahead of the tank 215 to compensate for a current impact shortfall value. The laser spot at time 1 can be seen to be striking the ground 218 in front of the tank 215.

At a time marked 2, the laser spot moves out from under the LGW's 220 flight path forcing it to maneuver toward a new location. At a time marked 3, the LGW 220 falls further behind the laser spot. At a time marked 4, the LGW's 220 flight path is pulled even more. At a time marked 5, the LGW travels until it runs out of maneuver space and is seen to shortfall the laser spot at time 5 by a distance that is based at least in part on the speed of the tank 215 resulting in the LGB 220 hitting the tank 215.

Figure 2B:
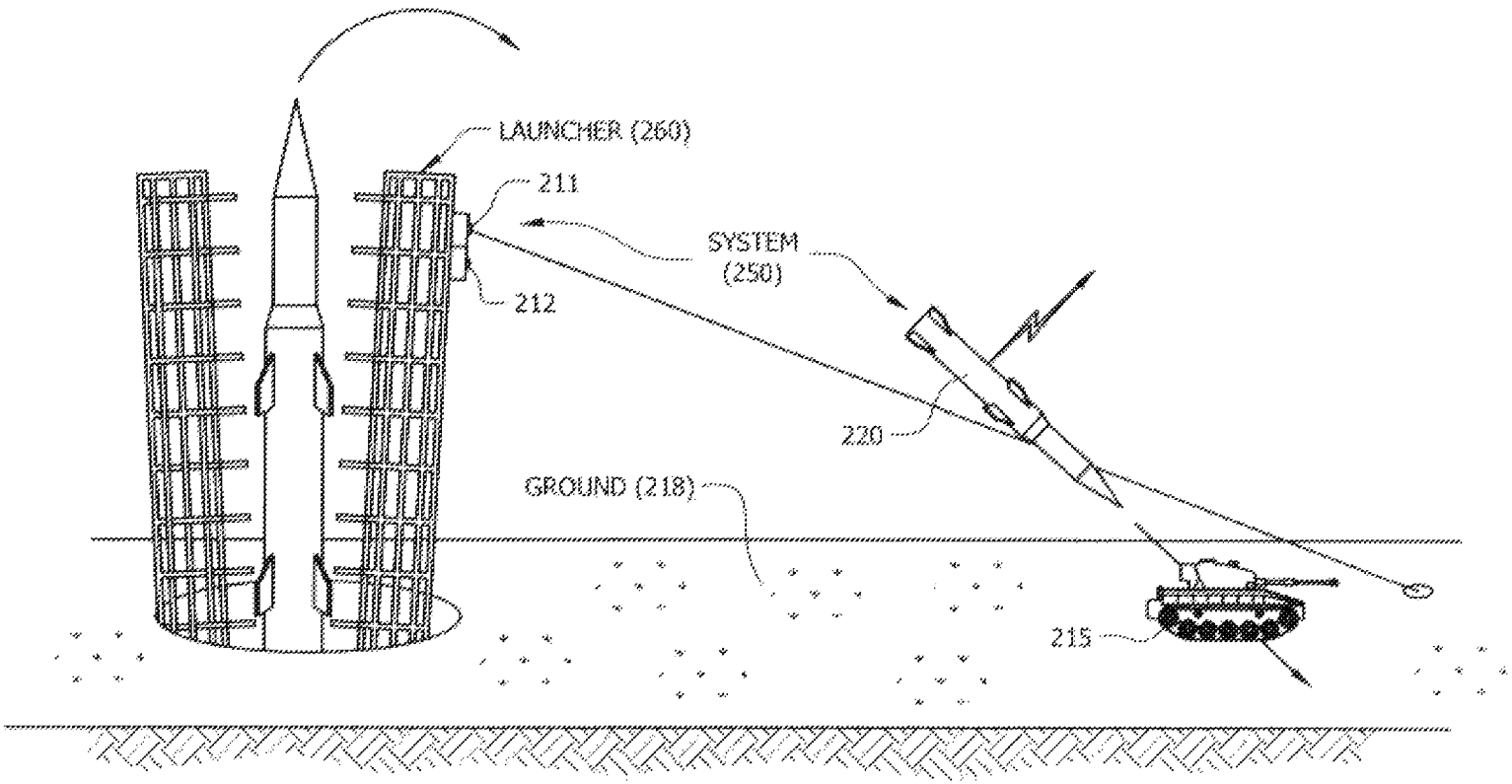
FIG. 2B is a depiction of a LGW delivery system showing the laser lead designator being at a ground-based launch site, according to a disclosed embodiment.

Although the laser designator 211 in FIG. 2A is shown provided by a jet aircraft 210, as described above, the laser designator 211 can be satellite or ground-based, such as at a ground-based launch site. FIG. 2B is a depiction of a LGW delivery system 250 showing the laser lead designator 211 and laser tracker 212 being at a ground-based launch site, according to a disclosed embodiment. LGW delivery system 250 includes launcher 260. Roughly analogous to the time marked 4 in FIG. 2A, the laser spot from laser designator 211 is seen to lead the tank 215 by a specified lead distance ahead of the tank 215 to the position on the ground shown to compensate for the estimated impact shortfall value.

Figure 3:
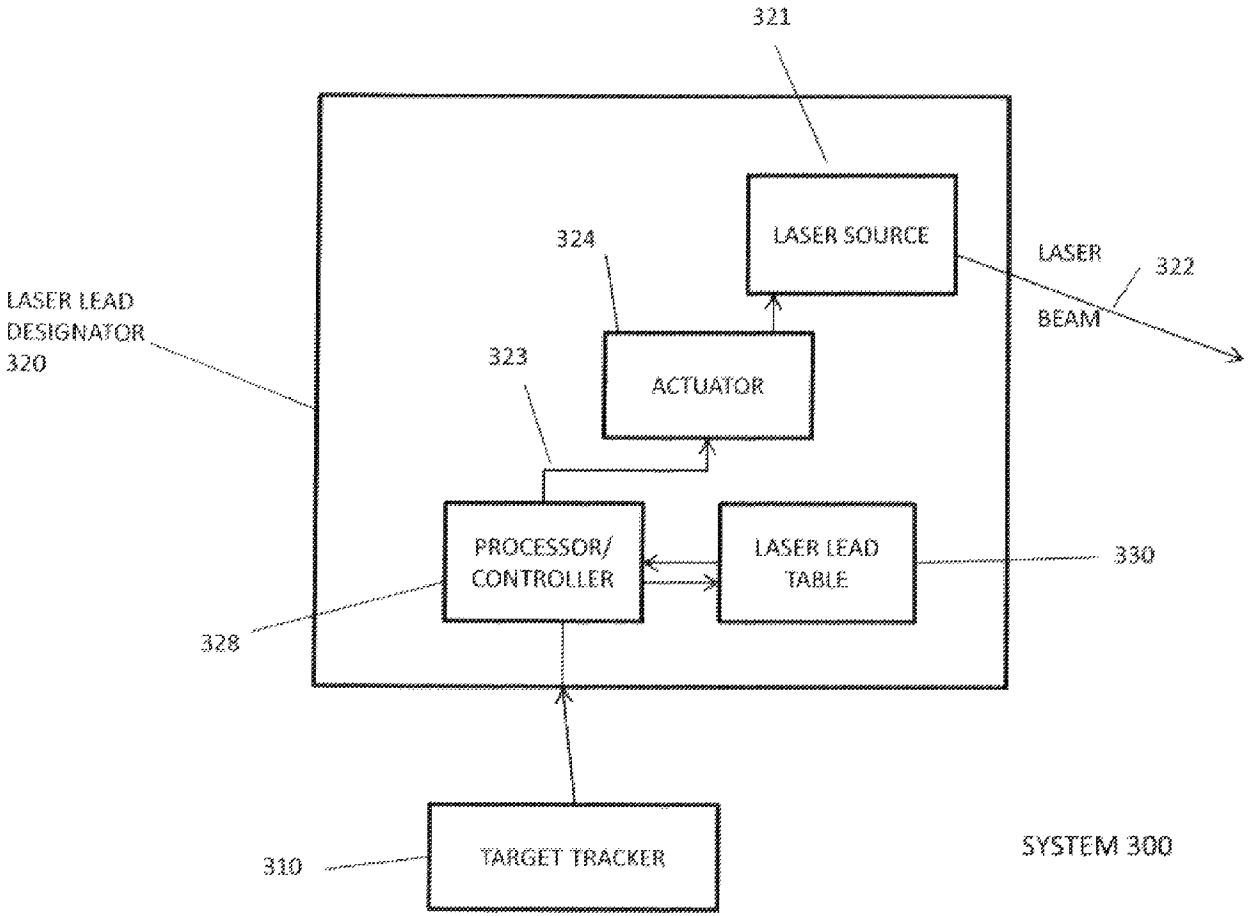
FIG. 3 is a block diagram depiction of a laser lead designator and target tracker system, according to a disclosed embodiment.

FIG. 3 is a simplified block diagram depiction of an integrated laser lead designator and target tracker system 300, according to a disclosed embodiment. System 300 includes a target tracker 310 for determining a position and a velocity of a moving target. As described above, target tracker 310 can be embodied as a laser tracker or a passive tracker. Target tracker 310 can implement TSE. For example, in one embodiment the target tracker 310 implements a track filter TSE algorithm, which is used in conjunction with inertial navigation system (INS) generated position and attitude data (e.g., from the aircraft the system is used on) and 2D image data captured by a camera or other imaging device.

System 300 also includes a laser lead designator 320 that is co-located with the target tracker 310. Laser lead designator 320 comprises a laser source 321 that provides a pulsed laser beam 322. A processor/controller 328 is coupled to an output of the target tracker 310 to receive position and velocity data of the moving target. Using laser lead table 330, processor/controller 328 determines a specified lead distance ahead of the moving target that is based at least in part on the speed of the moving target to generate a control/command signal that is sent to the laser actuator 324 for pointing the laser beam 322 so that the resulting laser spot is positioned on the ground the specified lead distance ahead of the moving target.

The contents of laser lead table 330 can be determined by simulation based on a suitable algorithm, and generally includes separate entries for each specific LGW supported since different LGW's generally have different maneuver capability and acceleration characteristics. By compiling different tables for different weapons (that generally provide different accelerations and maneuver capabilities), stored information can support laser lead guidance as disclosed herein to support a plurality of different LGWs. An alternative to a laser lead table 330 is a computation that can be performed by a suitable computational device (e.g., DSP, FPGA or an ASIC) that implements a calculation based on a laser lead algorithm to generate appropriate specified lead distance given the shortfall parameter(s) employed in the calculation.

The specified lead distance, which can equivalently be expressed as a target relative heading angle, results in the laser spot incident on a ground location ahead of the moving target that compensates for an impact shortfall value so that the LGW shortfalls the laser spot by a distance that is based at least in part on the speed of the moving target. As described above, since the lead distance is the distance the processor/controller 328 expects the LGW to shortfall the spot, the lead distance for the laser spot and the shortfall distance are generally equal, including the time immediately before the LGW hits the target.

As described above, in one embodiment, system 300 is mounted in an aircraft. In other embodiments, system is ground-based. In another embodiment, the target tracker 310 and laser lead designator 320 are separated from (i.e. not integrated with/co-located) one another. For example, target tracker 310 can communicate with laser lead designator 320 using over-the-air communications.

Disclosed embodiments provide several significant advantages. For example, as noted above, there is no need to modify LGWs since the LGWs do not need to receive lead information but rather fly to the off target laser spot to shortfall on the target, that without utilizing a disclosed embodiment would shortfall well behind a moving target and thus miss the target. Therefore, implementation of disclosed embodiments involves small changes to the laser designator (i.e. software/algorithm, and data e.g. stored tables) to provide a laser lead designator and no changes to the LGWs, thus providing a minimum cost solution to the moving target problem while enabling utilization of existing LGWs. Moreover, implementation in a single targeting system can support a large number of different LGWs can make existing LGW designs suitable for this new target set.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this Disclosure belongs. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

The invention claimed is:

1. A laser lead designator for guiding a laser guided weapon (LGW) to strike a moving target, comprising:

a laser source for providing a laser beam, and a controller coupled to receive a position and a velocity of said moving target for providing a control signal for pointing said laser beam a specified lead distance ahead of said position of said moving target to position a resulting laser spot on a ground location ahead of said moving target to compensate for an impact shortfall value that is a function of at least one shortfall parameter including a speed of said moving target so that said LGW shortfalls said laser spot on said moving target, wherein said laser designator is separate from said LGW.

2. The laser lead designator of claim 1, wherein said specified lead distance is provided by a look-up table accessible by said controller.

3. The laser lead designator of claim 1, wherein said at least one shortfall parameter includes an engagement geometry and a maneuverability of said LGW.

4. The laser lead designator of claim 1, wherein said lead distance is adjusted to account for wind.

5. The laser lead designator of claim 1, further comprising a target tracker for determining said position and said velocity of said moving target, wherein said laser lead designator comprises an integrated laser lead designator and target tracker system.

6. The laser lead designator of claim 5, wherein said target tracker comprises a passive ranging tracker.

7. The laser lead designator of claim 5, wherein said target tracker comprises a laser ranger that implements target state estimation (TSE).

8. A laser guided weapon delivery system, comprising a laser guided weapon (LGW), and a laser lead designator for guiding said LGW to strike a moving target, comprising:

a laser source for providing a laser beam;

a target tracker for determining a position and a velocity of said moving target, and a controller coupled to receive said position and said velocity of said moving target for providing a control signal for pointing said laser beam a specified lead distance ahead of said position of said moving target to position a resulting laser spot on a ground location ahead of said moving target to compensate for an impact shortfall value that is a function of at least one shortfall parameter including a speed of said moving target so that said LGW shortfalls said laser spot on said moving target, wherein said laser designator is separate from said LGW.

9. The system of claim 8, wherein said specified lead distance is provided by a look-up table accessible by said controller.

10. The system of claim 8, wherein said at least one shortfall parameter includes an engagement geometry and a maneuverability of said LGW.

11. The system of claim 8, wherein said lead distance is adjusted to account for wind.

12. The system of claim 8, wherein said target tracker comprises a passive ranging tracker.

13. The system of claim 8, wherein said target tracker comprises a laser ranger that implements target state estimation (TSE).

14. The system of claim 8, wherein said LGW comprises a laser guided bomb (LGB) or a laser guided missile (LGM).

15. The system of claim 8, wherein said laser lead designator and said target tracker are co-located to provide an integrated laser lead designator and target tracker system.

16. A method for guiding a laser guided weapon (LGW) to strike a moving target, comprising:

tracking said moving target for determining a position and a velocity of said moving target;

releasing said LGW toward said moving target;

obtaining an impact shortfall value for said LGW relative to said moving target, wherein said impact shortfall value is a function of at least one shortfall parameter including a speed of said moving target;

commanding a laser lead designator comprising a laser source for generating a laser beam that is separate from said LGW to point said laser beam a specified lead distance ahead of said position of said moving target to position a resulting laser spot on a ground location ahead of said moving target to compensate for said impact shortfall value, and repeating said tracking, said obtaining and said commanding a plurality of times to update said specified lead distance, wherein said LGW adjusts its flight-path to follow radiation emanating from said laser spot, wherein at a terminal time said LGW runs out of maneuver space so that said LGW shortfalls said laser spot on said moving target.

17. The method of claim 16, wherein said specified lead distance is provided by a look-up table.

18. The method of claim 16, wherein said at least one shortfall parameter includes an engagement geometry and a maneuverability of said LGW.

19. The method of claim 16, wherein said lead distance is adjusted to account for wind.

20. The method of claim 16, wherein said laser lead designator is in an air-based position.

21. The method of claim 16, wherein said laser lead designator is in a ground-based position.

22. The method of claim 16, wherein said tracking comprises passive ranging.

23. The method of claim 16, wherein said tracking includes laser ranging that implements target state estimation (TSE).

* * * * *